United States Patent [19]

Zelina et al.

[11] 4,424,468

[45] Jan. 3, 1984

[54] INVERTER BALLAST CIRCUIT WITH SHOOT THROUGH PREVENTION, AUTO TRANSFORMER COUPLING AND OVERLOAD PREVENTION

[76] Inventors: Francis J. Zelina; William B. Zelina, both of 6410 W. Ridge Rd., Pa. 16506

[21] Appl. No.: 312,908

[22] Filed: Oct. 19, 1981

Related U.S. Application Data

[63] Continuation-in-part of Ser. No. 280,866, Jul. 6, 1981, abandoned.

[51] Int. Cl.[3] ..... H05B 37/02

[52] U.S. Cl. ..... 315/222; 315/209 R; 315/219; 315/223; 315/244

[58] Field of Search ..... 315/209 R, 219, 222, 315/224, 244; 331/113 A

[56] References Cited

U.S. PATENT DOCUMENTS

| | | | |
|---|---|---|---|
| 3,753,071 | 8/1973 | Engel et al. | 315/201 |
| 4,042,852 | 8/1977 | Zaderej et al. | 315/219 |
| 4,045,711 | 8/1977 | Pitel | 315/DIG. 2 |
| 4,109,307 | 8/1978 | Knoll | 315/247 |
| 4,127,798 | 11/1978 | Anderson | 315/209 R |
| 4,251,752 | 2/1981 | Stolz | 315/208 |
| 4,277,728 | 7/1981 | Stevens | 315/247 |
| 4,346,332 | 8/1982 | Walden | 315/244 |
| 4,370,600 | 1/1983 | Zansky | 315/244 |

*Primary Examiner*—Harold Dixon

*Attorney, Agent, or Firm*—Charles L. Lovercheck; Wayne L. Lovercheck; Dale R. Lovercheck

[57] ABSTRACT

An inverter ballast for fluorescent lamps utilizing a resonant circuit coupled to the lamp and operated from a source of DC power through transistors. The transistors are controlled by a sensing means in the resonant loop which insures that the transistor switch at zero current. Furthermore, the coupling means for the load controls a source of heater voltage to the anodes of the fluorescent light which operate at very low current, an antisaturation circuit made up of separate windings are on the current transformer and connected to the switching transistor bases and through diodes to the power supply to prevent "shoot through" current in the transistors. An autotransformer is used as a high leakage reactance transformer; and a circuit is provided to prevent overload of the resonant circuit in case of lamp failure. Shoot through currents are prevented, and overload of the resonant circuit is prevented, and an autotransformer coupling of the resonant circuit to the load is used.

7 Claims, 4 Drawing Figures

INVERTER BALLAST CIRCUIT WITH SHOOT THROUGH PREVENTION, AUTO TRANSFORMER COUPLING AND OVERLOAD PREVENTION

REFERENCE TO PRIOR APPLICATION

This application is a continuation in part of application Ser. No. 280,866 filed July 6, 1981, now abandoned.

REFERENCE TO PRIOR ART

U.S. Pat. Nos. 4,023,067 and 3,753,076 show inverter ballasts for fluorescent lamps. U.S. Pat. No. 3,753,076 shows an inverter circuit which utilizes the energy stored in a resonant circuit to reduce input current to a value near zero during switching. U.S. Pat. No. 4,023,067 shows an inverter circuit that provides minimum switching losses by use of resonant storage techniques and a unique feedback system. It attempts to promote zero current switching. The present circuit assures zero current switching and efficient switching component operation, autotransformer coupling and overload protection.

BACKGROUND OF INVENTION

General

The superior lumen per watt characteristic of fluorescent lamps has for decades prompted research on ways to operate these lamps from a DC supply. These applications included the transportation industry (trains, transit cars, buses and airplanes) and the portable lighting industry. In these applications, no AC power is available and therefore the premium cost of these inverter ballasts was justified since the only alternate light source was the incandescent lamps (about 15 lumens per watt). When compared with fluorescent lamps of about 50 lumens per watt and about 10 times the life, the additional inverter ballast cost was justified.

It has been demonstrated as early as the early 50's, that the fluorescent lamp, when properly operated at frequencies above 15 KHZ, would demonstrate about 15% improvement in the output lumens per watt over 60 HZ operation. This well recognized fact, plus the present impetus on energy saving, has been the driving force behind multi-million dollar research and development efforts to apply high frequency lighting to commercial, industrial, and consumer applications. To date, there has been limited success in this effort. The reason for this record can be understood by studying the complexity of the problem added to the economics of the situation. Many efforts produced costs many times that of the 60 HZ Ballast counterpart with efficiencies, or ballast losses comparable or worse than the 60 HZ Ballast. Further, 60 HZ Ballast manufacturing has generally responded with better steel and more copper to improve their efficiency. This application discloses a means for preventing shoot through currents in the switching transistors, overload protection of the resonant circuit and autotransformer coupling means.

Teaching contained herein goes an order of magnitude further than prior circuits in that instead of promoting zero current switching, it assures it. Further, the start up transient is addressed in such a manner that the switching devices are less stressed during start up. Still, the above solutions have been accomplished in such a manner that a cost effective solution has been demonstrated. The 25% to 30% overall energy savings with no change in light output can easily justify the higher inverter ballast costs.

THE PROBLEM

The problem of making High Frequency available for general fluorescent lighting can be defined in the following categories:

A. Efficiency—must approach 95%. This makes payback an economic reality.

B. Cost—The cost of the High Frequency Ballasts must be no more than 2 or 3 times the cost of the 60 HZ Ballast.

C. Reliability—The inverter ballast must match or better the 60 HZ Ballast.

D. Life—Typical life must exceed ten years.

Many of the above problems are interdependent. For example, 95% efficient means extremely small losses and therefore low temperature rise, which generally means high reliability and long life. However, generally, cost tends to increase when the above objectives are addressed. We can then summarize our problem statement by saying the following: We must find a solution, if one exists, that will demonstrate the high efficiency and low loss with primary effort on production simplicity and low costs.

Solution to Problem

It has been generally accepted by these inventors since their first lighting of a fluorescent lamp with an inverter ballast, in the mid 50's, that resonance plays a dominant factor in ballast efficiency. However, maintaining resonance with component tolerances in production and during aging of the ballast appeared to be an impossible problem. In 1970, during work on the Coleman Camping Lantern ballast, the inventors were successful in providing resonant feedback which solved the above problem and produced efficiencies approaching 90%. This technology is used extensively in the transit industry and is the basis of U.S. Pat. No. 3,753,076. Following this work, a single transistor resonant feedback ballast was developed which approached 95% efficiency. This technology is the basis for most of the low voltage camping lantern ballasts made today, for example U.S. Pat. No. 4,023,067. The resonant feedback *promotes* zero current switching of the transistor thereby providing the high efficiency.

The teaching contained herein goes an order of magnitude further in that, instead of promoting zero current switching, it *assures it.* Further, the start up transient is addressed in such a manner that the switching devices are less stressed during start up. Still, the above solutions have been accomplished in such a manner that a cost effective solution has been demonstrated. The 25% to 30% overall energy savings with no change in light output can easily justify the higher inverter ballast cost. Retrofitting field ballast should be possible with an approximate one year payback, depending upon local energy and labor costs.

SUMMARY OF INVENTION

The solution to the problem stated above will be described using FIG. 1 through FIG. 3. Before we start, we should review our knowledge of simple series resonant circuit operation. It should be recalled that in a simple series resonant circuit the voltage across the capacitor will be 180 degrees out of phase with the inductance and the current flowing will be 90 degrees out of phase with both the capacitor and inductor voltages ignoring leading and lagging relationships. With reference to FIG. 1, one skilled in the art can determine relative relationships of the electrical quantities without experimentation. Note also that when current $I_r$ (resonant current) goes through zero, the stored energy in condenser 122, (C) is a maximum ($\frac{1}{2}$ C $V_c^2$) and the stored energy in (the reactance 114 and 118) L is at zero ($\frac{1}{2}$ L $I_r^2$).

If we can inject energy into the tank as $I_r$ goes through zero, 111 will switch at zero current and conduct a half sine wave of current into the LC tank circuit. If, as $I_r$ goes through zero, we turn 111 off and 112 on, we take the stored energy in Condensor 122 and transfer it in reverse polarity to Condensor 122. In this fashion, we continue to increase stored energy and voltage (the same) in the tank circuit. If energy is not removed from the resonant tank, voltages (energy) will build to component destruction.

Now, we must address ourselves to a better understanding of gas arc lamps (fluorescent lamps). Their general characteristic is such that an arc ionization voltage of about 6 to 10 times the operating voltage required. If we couple the fluorescent lamp into the tank circuit by a second winding on inductor 117, see FIG. 1, the lamp will ionize and then the voltage will stabilize at the operating arc voltage of the particular lamp used. The tank circuit via transistor 111 will accept exactly the energy each cycle that the lamp removes for operation. Further, since heating energy is only required for starting, we can see that starting to operate cathode heater watts are about 36 to 1, and up to 100 to 1 (square of starting and operating cathode heater voltage). This is a very desirable characteristic since it conserves energy during operation, thus providing the maximum possible lumens per input watt.

Further, we should consider the fluorescent lamp characteristic. It is such that the lumen efficiency is adversely affected by form factors drastically different from a sine wave. (Peak to RMS ratio). Because of the sinusodial operation of the tank circuit we deliver a very acceptable wave shape to the lamp. This further improves lumen efficiency over other inverter ballast approaches. The present invention, in addition, discloses a means for limiting transistor shoot through current; provides autotransformer coupling, and likewise provides protection for the circuit against overloads and open circuits and also provides an autotransformer.

OBJECTS OF THE INVENTION

It is an object of the invention to provide an improved inverter circuit.

Another object of the invention is to provide a combination inverter circuit and means to connect the inverter circuit to a load and means to switch the resonant current in the inverter circuit when the resonant current passes through zero in combination with an improved circuit to prevent "shoot through" current in the transistors, and overload protection.

Another object is to provide an inverter circuit which is simple in construction, economical to manufacture and simple and efficient to use.

Another object of the invention is to provide an improved inverter ballast.

It is a further object of the invention to provide an inverter circuit which will reduce switching time of transistors.

Another object of the invention is to provide an autotransformer coupling means for the circuit.

Another object of the invention is to provide an overload prevention circuit.

Another object of the invention is to provide an autotransformer coupling circuit for the circuit according to the invention.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

DETAILED DESCRIPTION OF THE DRAWING

Figure 1:
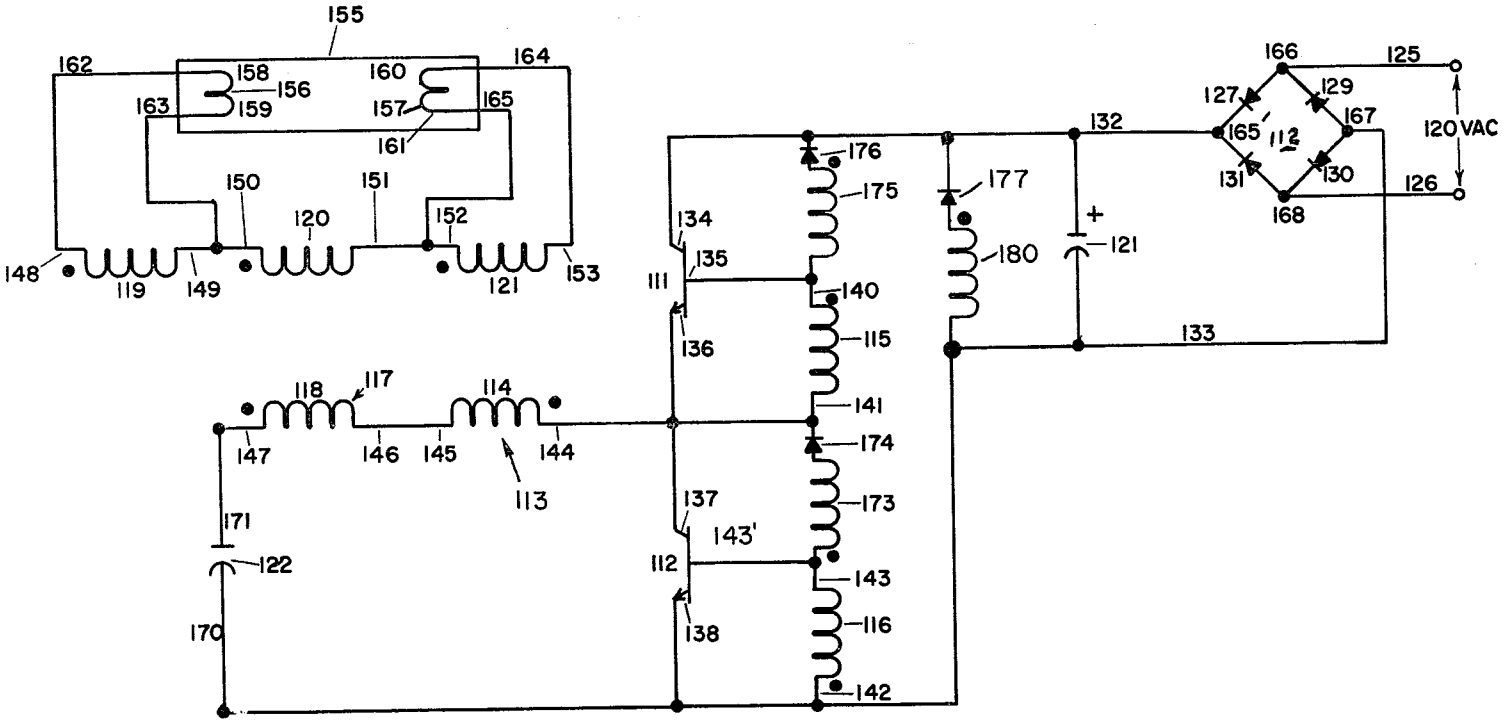
FIG. 1 is a schematic view of a circuit to reduce or eliminate shoot through current in the transistors, which also provides overload protection for the resonant circuit.

Now, with more particular reference to the drawings, and particularly FIG. 1, we show an inverter ballast circuit for a load which, in this case, is a fluorescent lamp 155. The inverter ballast circuit is made up of the primary windings 114 of current transformer 113 and a reactive element which is in this case a transformer. The windings 114 and 118 are connected in series with each other by means of their terminals, 145, 146, respectively. The resonant capacitor 122 has terminals 170 and 171 connecting it into the resonant circuit.

The Resonant Oscillator

The oscillator used to generate a high frequency voltage for driving the fluorescent lamp 155 is a two transistor *resonance maintenence* circuit. When power is applied to the input terminals, 166 and 168 of the full-wave rectifier 12, the input voltage is filtered by the capacitor 121, this DC voltage is applied to the network which includes transistors 111 and 112, causing transistor 111 to turn on. This causes capacitor 122 to start charging through primary winding 114 and winding 118. The winding 118 of the reactive element 117 is magnetically coupled to secondary windings 119, 120 and 121. Secondary winding 120 is used to drive the fluorescent lamp 155 which is of the ionizable gas type lamp.

The current transformer 113 is used to sense current flow in the resonant loop and to synchronize the switching of transistors 111 and 112. When current is flowing into the terminal 144 (dots on the drawing indicate instant polarity at a given time) current is flowing out of terminal 140 because the windings of transformer 13 are magnetically coupled. This turns transistor 111 on and turns transistor 112 off. When condensor 122 becomes fully charged, current flow passes through zero and reverses in the resonant loop. This reversal of current is sensed by the current transformer 113 which turns off transistor 111 and turns transistor 112 on. Capacitor 122, through resonant action will transfer its charge to the opposite polarity, again causing current to pass through zero and reverse in the resonant loop. This second reversal is sensed by transformer 113 which turns transistor 111 on and turns transistor 112 off.

Transistors 111 and 112 are now maintaining resonance in the resonant loop. This oscillating current and the subsequent voltage generated by this charging and discharging of capacitor 122 generates a voltage in winding 118. This voltage can be either stepped up or down, to meet the requirements of any size fluorescent lamp connected to the output of secondary winding 120.

The resonant frequency of the oscillator is set by the size of capacitor 122 and the inductance of winding 118. The ratio of turns of winding 118 to secondary winding 120 is utilized to reflect the fluorescent lamp load impedance into the primary circuit in order to dampen the resonant loop.

The reactive element 117 has secondary windings 119, 120, and 121, having terminals 148, 149, 150, 151, 152 and 153, respectively.

Transistor 111 is connected to the DC load supply, line 132, which is connected to the terminal 165 on the full wave rectifier circuit made up of rectifiers 127, 129, 130 and 131, having terminals 166 and 168 connected to the 120 VAC power lines 125 and 126 and the terminals 165 and 167 connected to the circuit terminals 132 and 133. The filter capacitor 121 is connected across the lines 132 and 133 to filter the DC current from the full wave rectifier.

The secondary windings 116 and 173 of current transformer 113 are connected in series and to the base of transistor 112 at 143. The terminal 141 is connected to diode 174 and to the line connecting the emitter 136 of transistor 111 and the collector 137 of transistor 112. The winding 115 and 175 are connected in series with each other and through diode 176 to line 132 and the winding 115 is connected directly to the line 144 connecting the transistor terminals 136 and 137 to winding 114 and windings 115 to 173 through diode 174.

In normal operation, the diode 177 and tap 180 perform no function. However, should the lamp 155 be disconnected from the circuit thereby providing an open circuit condition of the load, the voltage in the circuit would build up to the point of self-destruction. By the addition of diode 177 the excess voltage will be reflected back into the input circuit thereby limiting the buildup of voltage in the resonant circuit and avoiding damage. Diode 177 will conduct to load the resonant circuit thereby limiting the voltage to a safe value.

SHOOT THROUGH CIRCUIT

In the patent application, the current transformer 13 acts to exactly syncronize the switching of transistors 111 and 112 with the resonant current in the resonant loop. Applicants have observed that a "shoot through" current occurred each time either transistor 111 or 112, in the parent application, were turned "on". This was due to the one to two microsecond storage times of transistors 111 and 112. It appeared that the long switching times were caused by overdriving the transistors 111 and 112 into saturation, thereby storing excessive base emitter charges.

To remedy this situation, two windings 173 and 175 were added to the current transformer 113 and isolation diodes 174 and 176 were added.

Even though the Applicant is switching the transistors as the resonant current in winding 114 passes through zero, the problem of generating shoot through currents in standard quality transistors still occurs. A shoot through current is one that flows or shoots through both transistors from supply B+ to supply B−, when both transistors are on at the same time. As the resonant current passes through zero, if one transistor does not turn off before the other turns on a shoot through current will flow until the transistor turns off. This turn off delay occurs if a transistor is driven into the region known as saturation; that is where an excessive amount of charges become stored in the transistor base-emitter junction and hold the transistor on, even though the base turn-on signal has been removed. The length of the turn off delay is determined by the length of time required for the stored charges to be swept away or dissipated.

Applicant prevents shoot through currents from being generated in standard quality transistors by preventing the transistors from being driven into the saturation region. This prevents an excessive amount of charges from being stored in the base-emitter junction which prevents the transistors from delaying their turn off when the resonant current passes through zero.

The shoot through prevention is done by connecting the additional current transformer windings 173 and 175 through diodes 174 and 176 to the collector junctions of each transistor. As the collector-emitter junction 134–136 or 137–138 voltage starts to approach a value which indicates transistor saturation, the additional diode 174 or 176 conducts through the additional winding 173 or 175 which pulls away the base drive current or starves the base 135 or 143'. This stops the transistor from entering the saturation region and regulates the collector-emitter voltage at a value outside of saturation. Since the transistor did not saturate, no excessive charges are stored and therefore no turn off delay will occur with standard quality transistors. The arrangement was completely effective and "shoot through" current completely dissappeared. Still the recovery time of diodes 174 and 176 must be fast (nanosecond range) for optimum operation.

In order to provide fast switching of the transistors and to prevent shoot through currents, diodes 174 and 176 and windings 173 and 175 are provided. The diodes 174 and 176 are connected in series with the windings 173 and 175, respectively. These diodes connected to the transformer windings 173 and 175 limits the transistor base current and clamp the collectors of the transistors to a voltage above saturation.

It has been observed that a shoot through current occurs each time either transistor 111 or 112 turns on. This is due to one to two microseconds turn on and turn off time of the transistors 111 and 112. This poses a serious limitation to the invention due to the operating efficiency of the transistors. The rather long switching time without the shoot through prevention circuit is normally caused by overdriving the transistors 111 and 112 into saturation thereby storing excessively base emitter charges. To prevent shoot through, three turns (point 1 V-turn) were added to the transformer 113 and isolation diodes 174 and 176 are added.

This arrangement effectively regulates the turn on voltage of 111 and 112 since, as the turn on voltage attempts to go to saturation, its collector draws current through the diodes 174 and 176 to starve their bases, thereby limiting the base to emitter stored charge. This arrangement is completely effective and "shoot through current" completely disappears when the transformer windings and diodes 174 and 176 are used as shown.

OVERLOAD PROTECTION CIRCUIT

Figure 4:
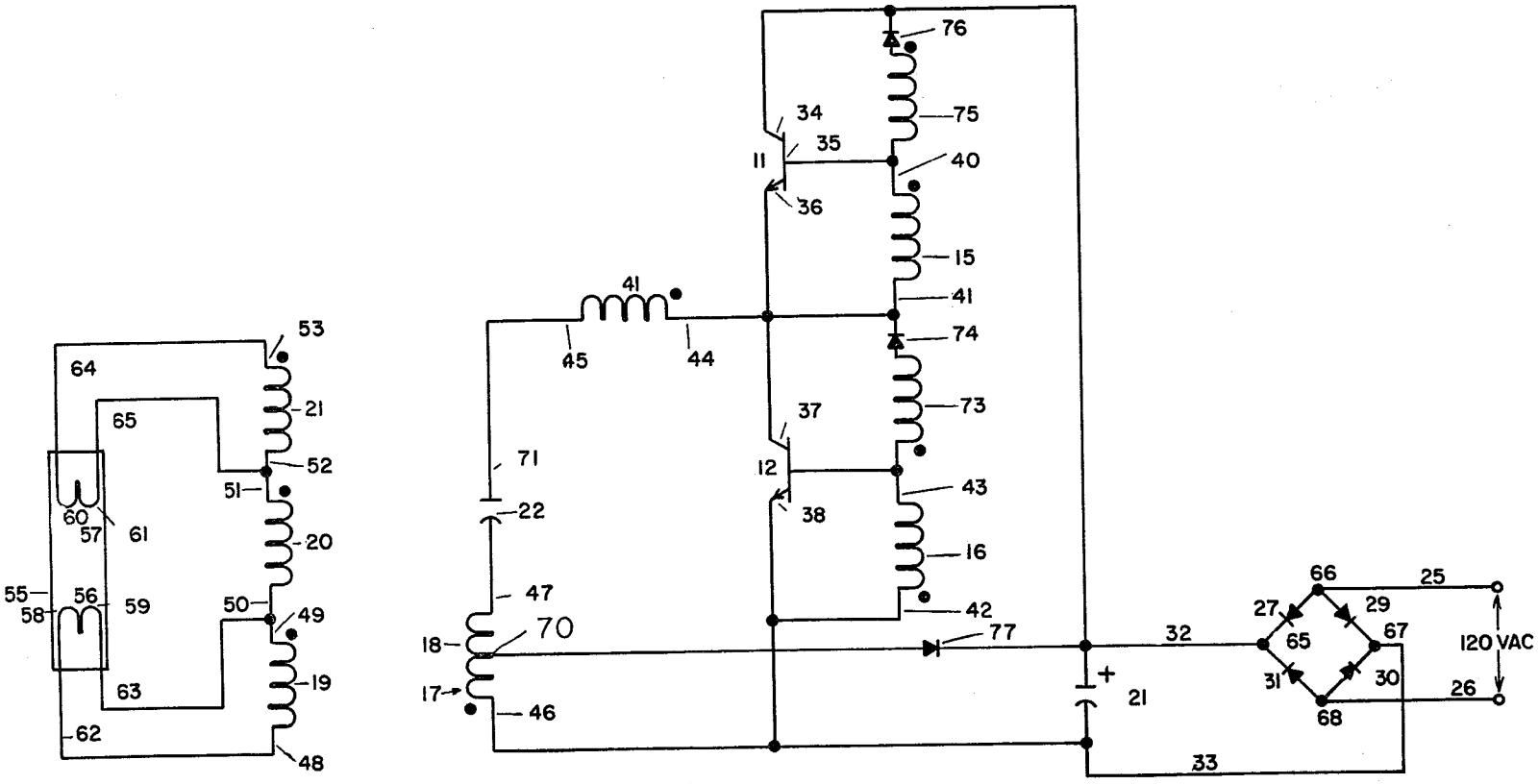
FIG. 4 is another embodiment of the overload protection circuit.

Referring to FIG. 4, in case lamp 55 is removed from the circuit (no load on the resonant circuit) circuit destruction will result. In order to prevent this, emergency diode 77 is added which will conduct to load the resonant circuit in case of overload thereby limiting the resonant voltage to a safe value. In normal operation, the diode 77 and tap 70 perform no function. However, should the lamp 55 be disconnected from the circuit thereby providing an open circuit condition of the load, the voltage in the circuit would build up to the point of self-destruction. By the addition of diode 77 the excess voltage will be reflected back into the input circuit thereby limiting the buildup of voltage in the resonant circuit and avoiding damage.

Diode 77 will conduct to load the resonant circuit thereby limiting the voltage to a safe value.

In the embodiment of the invention shown in FIG. 4, we show a circuit similar to the circuit shown in FIG. 1. But having a center tap 70 on the primary 18 of transformer 17. The center tap 70 is connected through diode 77 to the line 32.

The fluorescent lamp 55 is connected to the circuit similar to circuit shown in the previous embodiments. The input voltage is filtered by the capacitor 21, this DC voltage is applied to the network which includes transistors 11 and 12 causing transistor 11 to turn on. This causes capacitor 22 to start charging through primary winding 14 and primary winding 18. The winding 18 of the reactive element 17 is magnetically coupled to secondary windings 19, 20 and 21. Secondary winding 20 is used to drive the fluorescent lamp 55 which is of the ionizable gas type lamp.

Transformer 13 is a current transformer used to sense current flow in the resonant loop and to syncronize switching of transistors 11 and 12. When current is flowing into the terminal 44 (dots on the drawing indicate instant polarity at a given time) current is flowing out of terminal 40 beause the windings on transformer 13 are magnetically coupled. This turns transistor 11 on and turns transistor 12 off. When condenser 22 becomes fully charged, current flow passes through zero and reverses in the resonant loop. This reversable current is sensed by the current transformer 13 which turns off transistor 11 and turns on transistor 12. Capacitor 22 through resonant action will transfer charge to the opposite polarity again causing current to pass through zero and reversing the resonant loop. This second reverse will be sensed the transformer 13 which turns transistor 11 on and transistor 12 off.

Transistor 11 and 12 are now maintaining resonance in the capacitor 22 loop. This oscillating current and the subsequent voltage generated by this charging and discharging of capacitor 22 generates a voltage in winding 18. This voltage can be either stepped up or down to meet the requirements of any size fluorescent light connected to the output secondary winding 20.

The secondary windings 19, 20 and 21 having terminals 48, 49, 50, 51, 52, and 53, respectively, are connected to the fluorescent light 55 and terminal 58, 59, 60 and 61 through lines 62, 63, 64 and 65. The secondary windings are magnetically coupled to the primary winding 18. Winding 18 has the center tap 70 connected through diode 77 to line 32 and the full wave rectifier circuit made up of diodes 27, 29, 30 and 31 connecting lines 25 and 26 to lines 32 and 33 which are a conventional full wave rectifier circuit filtered by capacitor 21.

AUTO TRANSFORMER CIRCUIT FIG. 2

Figure 2:
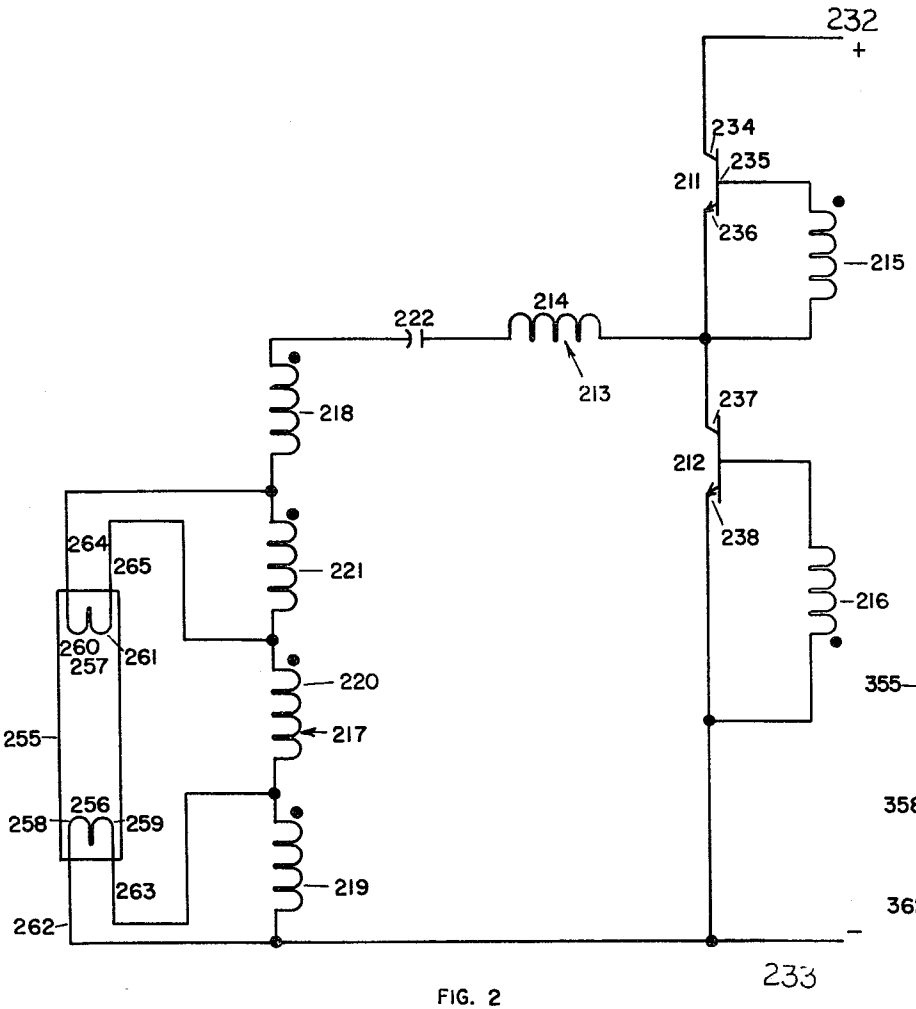
FIG. 2 is a circuit using nonisolated autotransformer for stepping down the load component of the resonant current to the fluorescent lamp.

Now, with reference to FIG. 2, the parts of the circuit corresponding to the similar parts in FIG. 1 have a prefix number of "2", instead of "1".

The circuit shown in FIG. 2 has the autotransformer coupling and is otherwise similar to that shown in FIG. 1.

Now with reference to FIG. 2, the fluorescent lamp load 255 is connected to the circuit similar to the circuit shown in the previous embodiment. The distinction of FIG. 2 is that an autotransformer 217 having a winding 218, 219, 220 and 221 forms a part of the resonant loop to operate the fluorescent lamp. This winding is supported in the tank circuit with the current transformer winding 214 of transformer 213. Transistors 211 and 212 are used as in the other circuits.

Figure 3:
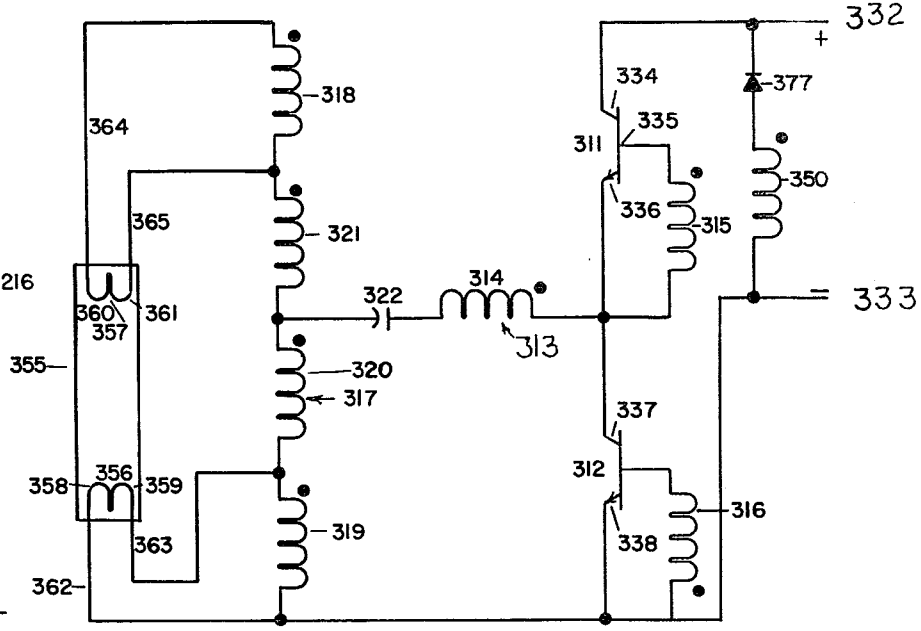
FIG. 3 is a step up autotransformer arrangement.

The advantage of the autotransformer is that an autotransformer is generally a more economical transformer to use since it saves weight of iron cores as well as additional winding material such as copper or aluminum, and has all of the advantages well known to the art of autotransformers. The resonant capacitor 222 is connected to windings 214 and 218, and fluorescent lamp 255 is connected to winding 220. This gives a step down of voltage to the lamp than in the arrangement shown in FIG. 3. In FIG. 3 windings 320 and 321 are connected to load 355 and windings 319 and 320 are in the resonant circuit with capacitor 322 and primary 314 of current transformer 313. Thus, the voltage to the lamp is stepped up. Winding 315 and 316 control the transistors 311 and 312. Clamping circuit made up of secondary winding 350 on transformer 317 and diode 377 protects the resonant circuit from overload.

The current transformers 313, can be made with a magnetic ring having a primary winding 313 two turns and secondary windings 215 and 216. The power supply to lines 332 and 333 are as in FIG. 1. Heaters 356 and 357 are operated by secondary windings 318 and 319. Windings 318 and 319 are connected to heaters 356 and 357 at terminals 358, 359, 360, and 361. Thus, the circuit requires very simple, low cost transformer components compared with most inverter ballast circuits. Winding 350 of transformer 317 in series with diode 377 and in parallel with lines 332 and 333 limits the current in the resonant circuit in case of an open circuited lamp. This invention teaches the use of (1) turn-on voltage regulation to provide fast switching of the transistors and eliminate shoot through, (2) clamping of the tank voltage to eliminate destruction of the tank circuit, (3) the use of autotransformer techniques for better economic system efficiency.

The foregoing specification sets forth the invention in its preferred, practical forms but the structure shown is capable of modification within a range of equivalents without departing from the invention which is to be understood is broadly novel as is commensurate with the appended claims.

In the embodiments of the invention in which an exclusive property or privilege is claimed are defined as follows:

1. A circuit for driving a load comprising,
a resonant circuit,
a power supply,
an inverter circuit, control means for actuating said inverter, a first transformer having a winding, a second transformer having a single primary winding, a first secondary winding and a second secondary winding, a condenser, a first electronic valve having an actuating means, a second electronic valve having an actuating means, said resonant circuit comprising said first transformer winding, said second transformer primary winding and said condenser connected in series with one another, said inverter comprising said first electronic valve and said second electronic valve, said first electronic valve being connected to said power supply and to said resonant circuit, said second electronic valve being connected in series with said resonant circuit forming a loop, said first secondary winding of said second transformer being connected to said actuating means on said first electronic valve, said second secondary winding of said second transformer being connected to said actuating means of said second electronic valve, said control means for actuating said inverter consisting of said second transformer, said second transformer first secondary being adapted to actuate said first electronic valve connecting said power supply to said resonant circuit to charge said condenser to a first polarity.

said second transformer second secondary winding being adapted to actuate said second electronic valve connecting said resonant circuit into a loop allowing current to flow in said loop to charge said condenser to a second polarity when the current in said resonant circuit passes through zero, and means on said circuit for connecting said first transformer winding to a load, said second transformer having a third secondary winding and a fourth secondary winding, said third secondary winding being connected to the actuating means on said second electronic valve and through a first diode to said first secondary, said fourth secondary winding of said second transformer being connected to said actuating means on said first electronic valve and through a second diode to said power supply.

2. The circuit recited in claim 1 wherein said load comprises a fluorescent light, means to connect said resonant circuit to a load comprises a first secondary winding on said first transformer adapted to be connected to said load and a second secondary winding and a third secondary winding on said first transformer, said second secondary winding and said third secondary winding of said first transformer being connected to the heaters of the fluorescent light connected to said first secondary winding.

3. The circuit recited in claim 2 wherein said first transformer has a fourth secondary winding connected in series with a third diode and said fourth secondary winding and said third diode is connected in parallel with said power supply whereby said fourth secondary winding has no function in normal operation but limits the build up of voltage to said resonant circuit in the event of an open circuit to said first secondary winding.

4. The circuit recited in claim 1 wherein said power source is a DC power supply.

5. The circuit recited in claim 1 wherein said first transformer has an overload protection circuit made up of a second winding on said first transformer and a third diode connected in series with said second winding, said second winding and said third diode being connected in parallel with said power supply.

6. The circuit recited in claim 1 wherein a second condenser is connected in parallel with said power supply and intermediate part of said first transformer winding is connected through a diode to said power supply.

7. The circuit recited in claim 1 wherein said first transformer has a second winding connected through a diode and in parallel with said power supply whereby excess voltage from said transformer will be reflected back into the input circuit thereby limiting the buildup of voltage in the resonant circuit and avoiding damage to said circuit when load the resonant circuit becomes excessive thereby limiting the resonant circuit voltage to a safe value.

* * * * *